US006581664B2

(12) United States Patent
Kröner et al.

(10) Patent No.: US 6,581,664 B2
(45) Date of Patent: Jun. 24, 2003

(54) ARTICULATED-ARM AWNING

(75) Inventors: Sven Kröner, Mettingen (DE); Luise Schniggendiller, Muenster (DE)

(73) Assignee: Schmitz-Werke GmbH & Co., Emsdetten (DE)

( * ) Notice: Subject to any disclaimer, the term of this patent is extended or adjusted under 35 U.S.C. 154(b) by 0 days.

(21) Appl. No.: 09/909,639

(22) Filed: Jul. 23, 2001

(65) Prior Publication Data

US 2002/0007922 A1 Jan. 24, 2002

(30) Foreign Application Priority Data

Jul. 22, 2000 (DE) ..... 100 35 797

(51) Int. Cl.[7] ..... E04F 10/06

(52) U.S. Cl. ..... 160/70; 160/79; 192/69.83; 192/69.7; 192/89.27; 192/96

(58) Field of Search ..... 160/70, 79, 59, 160/66, 67, 69, 72, 73, 78; 192/69.83, 69.7, 89.27, 96

(56) References Cited

U.S. PATENT DOCUMENTS 1,017,515 A * 2/1912 Daus
1,312,846 A * 8/1919 Hauser
1,681,292 A * 8/1928 Glover
1,759,715 A * 5/1930 Schane
2,038,259 A * 4/1936 Anton
4,784,204 A * 11/1988 Lohausen

FOREIGN PATENT DOCUMENTS

| | | |
|---|---|---|
| CH | 149635 | * 12/1931 |
| CH | 241851 | * 8/1946 |
| CH | 662859 | * 3/1984 |
| EP | 0 593 389 | 4/1994 |

* cited by examiner

*Primary Examiner*—Blair M. Johnson

(57) ABSTRACT

An articulated-arm awning having at least two articulated arms, each incorporating an inner and outer articulated arm section that are connected to one another by a joint having a substantially vertical swiveling axis. The outer articulated arm section of each articulated arm is connected in the region of its outer end to a dropout profile by a joint having a substantially vertical swiveling axis. The inner end of each inner articulated arm section that is located on the bearing side is connected to a bearing on the building side by a joint having a substantially vertical swiveling axis. A tilting joint around a horizontal swiveling axis is provided on each articulated arm.

7 Claims, 3 Drawing Sheets

ARTICULATED-ARM AWNING

BACKGROUND OF THE INVENTION

Field of the Invention

The present invention is directed to an articulated-arm awning comprising two or more articulated arms, wherein each articulated arm incorporates an inner and outer articulated arm section that are connected to one another by means of a joint having a substantially vertical swiveling axis, wherein the outer articulated arm section of each articulated arm is connected in the region of its outer end to a dropout profile by means of a joint having a substantially vertical swiveling axis, and wherein the inner end of the inner articulated arm section that is located on the bearing side is connected to a bearing on the building side by means of a joint having a substantially vertical swiveling axis, and wherein a tilting joint around a horizontal swiveling axis is provided on each articulated arm.

SUMMARY OF THE INVENTION

With a known construction of this type as the starting-point, the invention has as its object to attain a design that is as simple as possible, reliable in its operation, and easy to manufacture.

This object is met according to the invention in such a way that the articulated arm sections and joints are dimensioned and positioned such that when the dropout profile is retracted, a lateral force parallel to the dropout profile or building wall is exerted onto a tilting shaft that is mounted so that it can slide crosswise; that the tilting shaft on the bearing side is mounted so that it can slide in the direction of the lateral force against the force of a spring; that a clutch is provided that can be activated and deactivated in dependence upon this sliding movement such that when the dropout profile is retracted and the lateral force correspondingly exceeds that of the spring, the clutch is disengaged and permits a swiveling of the tilting shaft around a horizontal swiveling axis, and when the dropout profile is extended, the clutch is engaged and blocks the swiveling movement.

According to the invention, one thus takes advantage of the changing lateral force ratios during the extension and retraction of the awning fabric to attain a simple and reliable locking and protection against wind gusts in the extended condition, and a space saving design in the retracted condition.

In a further development of the invention, provision is made for the inner articulated arm section to be longer than the outer articulated arm section whereby the desired defined change in the lateral force is attained or supported.

Provision is advantageously made for the tilting shaft to be supported in the region of the bracket on two spaced-apart bearing rings, and for the spring to be formed by a helical spring that is disposed between the bearing rings on the tilting shaft.

To attain a defined shifting path in the lateral direction, two stop rings may be provided on both sides of one of the bearing rings.

According to a preferred embodiment, the clutch is formed by a clutch ring that is attached to the tilting shaft integral in rotation therewith and has axially extending clutch projections, and by clutch recesses that cannot rotate.

As soon as the projections engage into the recesses any swivel movement is stopped, whereas a free swivel movement is possible while the projections are moved out.

The clutch recesses are advantageously formed on the outside of the bearing ring, so that no additional component is required for this.

The invention will be explained in more detail below based on a preferred exemplary embodiment in conjunction with the drawings:

DESCRIPTION OF THE PREFERRED EMBODIMENT

Figure 1:
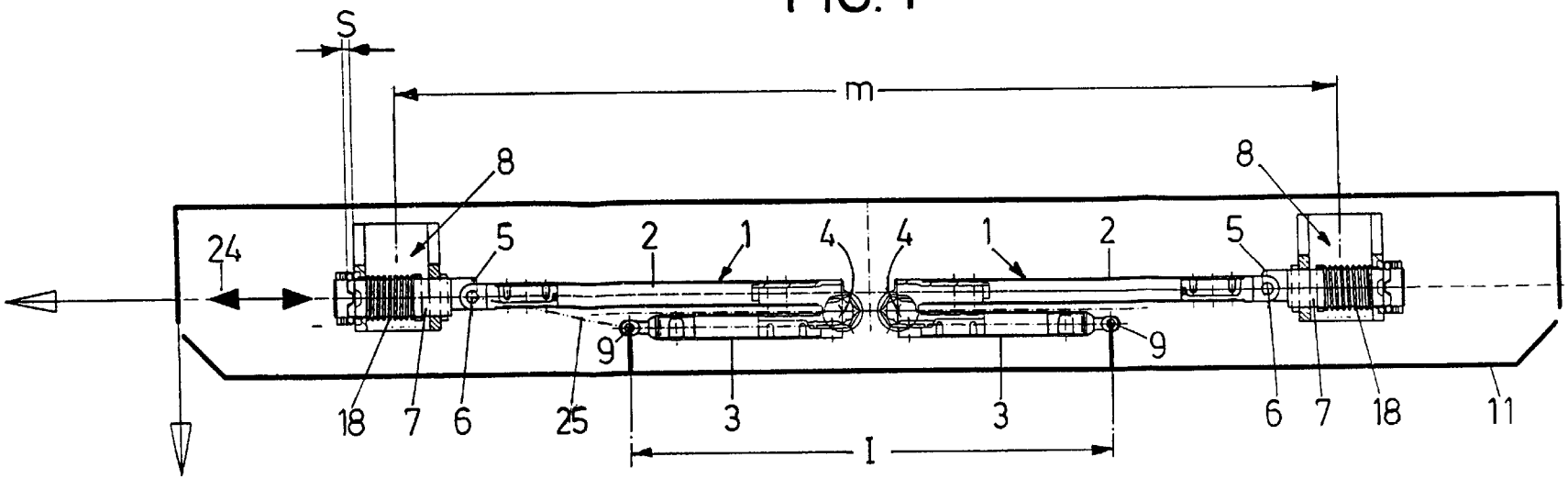
FIG. 1 shows a horizontal section through an inventive articulated-arm awning in its retracted condition.

An inventive articulated-arm awning shown in the drawing comprises two articulated arms 1, each articulated arm 1 being formed by an inner, longer articulated arm section 2 and an outer, shorter articulated arm section 3, which are connected to one another by means of a joint 4 having a vertical swiveling axis. The inner articulated arm section 2 is connected by means of a joint 5 having a vertical joint axis 6 to a tilting joint 7, which is disposed on a bracket 8, which, in turn, is fastened to a wall (not shown in the drawing).

The outer articulated arm section 3 is connected with its outer end by means of a joint 9 having a vertical swiveling axis 10 to a dropout profile 11, and the distance I between the two joint axes is constant, as is the distance m between the two holding brackets 8 that are fastened to the wall.

Figure 3:
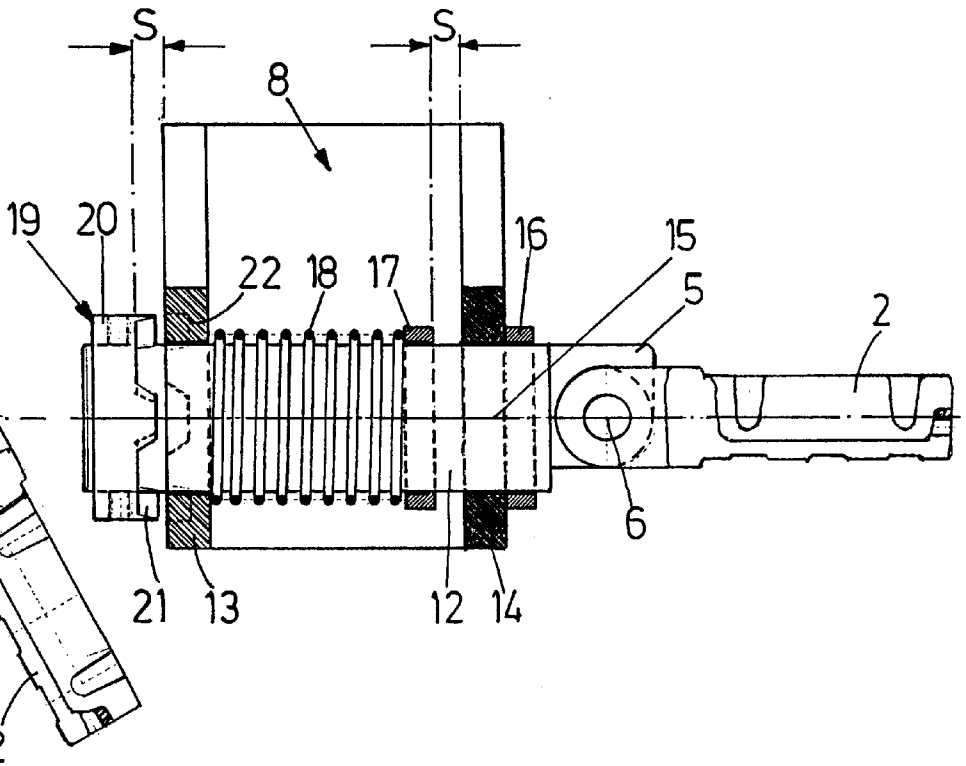
FIG. 3 shows an enlarged illustration of the tilting joint in the retracted condition.
Figure 4:
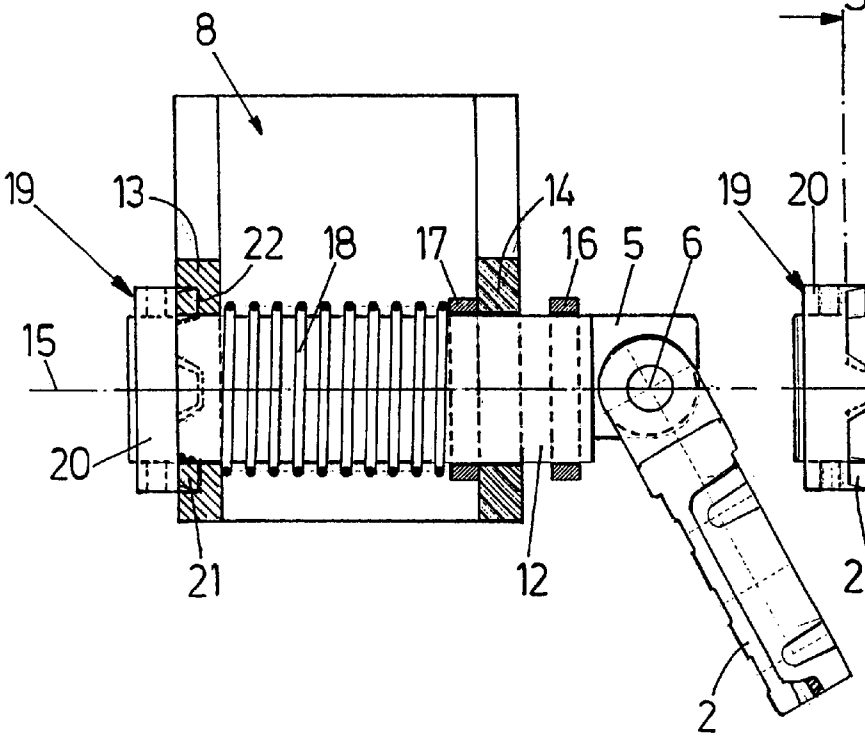
FIG. 4 shows an illustration corresponding to FIG. 3 in the extended condition.

The tilting joint 7 shown in more detail in FIGS. 3 and 4 comprises a tilting shaft 12 on which the tilting bearing 5 is formed in the region of what is shown as the right outer end in the drawing. The tilting shaft 12 is mounted on the bracket by means of two spaced-apart bearings 13, 14 so that it can slide crosswise, i.e., in the direction of the longitudinal axis 15 of the tilting shaft 12, and this sliding movement is limited to the left by a stop ring 16. A further stop ring 17 is fastened on the inside of the bearing 14 on the tilting shaft 12. Between this stop ring 17 and the bearing 13, the tilting shaft 12 has a helical spring 18 disposed on it that is supported on the stop ring 17 on one the hand and on the inside of the bearing 13 on the other hand.

A clutch device 19 is formed by a clutch ring 20 that sits on the free outer end of the tilting shaft 12. On the inside of the clutch ring 20, clutch projections 21 are provided that extend in an axial direction (see FIG. 3, in particular) and engage in corresponding clutch projection recesses 22 when in the engaged condition shown in FIG. 4, so that a twisting of the tilting shaft 12 relative to the bearings 13, 14 or brackets 8 is prevented, whereas such a twisting, or swivel, movement around the longitudinal or swiveling axis 15 is possible when the clutch ring 20 with the clutch projections 21 is shifted to the left by a distance S together with the tilting shaft 12, as shown in FIG. 3, said shifting movement (to the left in the drawing) being limited by the stop ring 16 (see FIG. 3) and the shifting movement in the counter-direction, i.e., to the right in the drawing, being limited by the stop ring 17.

The purpose of the above-described design is to allow the articulated arms 1 of the awning to swivel around the swiveling axis 15 in the region of the brackets 8 so that the smallest possible construction size is attained in the retracted condition. This is done by taking advantage of a lateral force acting in the direction of the arrow 24, which, due to the different length ratios of the inner articulated arm section 2 and outer articulated arm section 3 in cooperation with the spring force of the helical spring 18, leads to respective different resulting forces in dependence upon the extension condition of the awning or its dropout profile 11, taking into consideration the fact that the distance m between the brackets 8 and the distance I between the swivel axes 10 on the dropout profile 11 remains constant during the entire movement.

Figure 2:
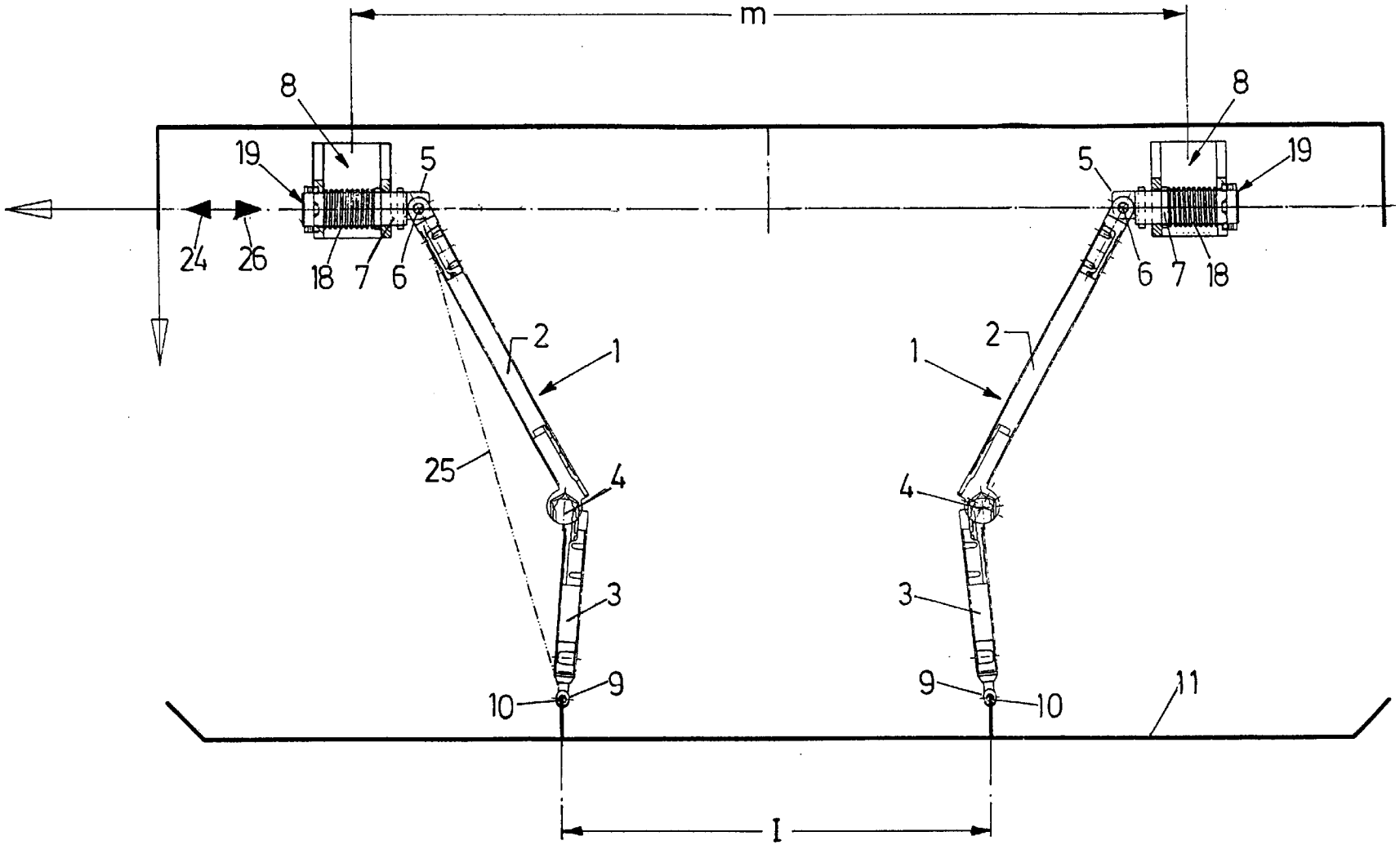
FIG. 2 shows a section through the awning in its extended condition.

The drawing shows the course of the working line 25 between the axis 10 of the swivel joint 9 on the dropout tube and the joint axis 6 of the joint 5 on the tilting shaft 12 on the bracket 8. From this it can be seen that a considerably higher lateral force is generated in the direction of the arrow 24 (which is counteracted by the spring force in the direction of the arrow 26) in the retracted condition, due to the flatter angle of this working line 25 relative to the axis 15, than in the extended condition shown in FIG. 2.

The resulting force that acts upon the clutch device 19 between the clutch projections 21 and clutch recesses 22 is thus at its largest in the retracted condition and decreases as the awning is extended.

In the retracted condition, the tilting shaft 12 is accordingly pushed to the outside, or to the left in the drawing, by a force resulting from the lateral force and spring force, and the clutch is opened so that a swivel movement around the axis 15 becomes possible. With the clutch 19 in this open position, the respective articulated arm 1 could move downward around the axis 15 of the tilting shaft 12 due to its dead weight and that of the dropout profile 11 if the awning fabric (not shown in the drawing) that is fastened to the dropout profile 11 did not prevent this movement. However, when the awning fabric is being unwound in the course of the extension operation of the winding shaft (which is also not shown in the drawing) the articulated arms 1 can swivel downward around the axis 15 due to the dead weight.

In order to be able to adjust a defined awning angle in the ultimately extended position and also maintain this adjustment with respect to attacking winds, the clutch 19 must lock the upward swivel movement in this condition, which—as explained above—is achieved in such a way that the resulting force changes its direction as the awning is extended further, and the clutch is brought, by the force of the helical spring 18, into the condition shown in FIG. 4 where the clutch projections 21 engage in the clutch recesses 22 and thus prevent a swivel movement. In this condition, the awning is secured with a defined angle of inclination against being thrown upward by attacking winds.

If the awning is now brought back to its retracted condition, the lateral force increases until the force of the helical spring 18 is overcome and the clutch 19 is opened by a movement by the distance S. The awning fabric correspondingly pulls the articulated arms 1 upward by a defined angle and this movement is limited by a rotation-limiting means in the form of a securing ring, which in the presented embodiment is formed by the stop ring 17.

The above described system opens up the following adjustment options:

The stop ring 16 can be used to adjust the pretensioning force of the helical spring 18 on the tilting joint 8.

The stop ring 16 permits a limitation of the upward swiveling of the tilting shaft 12.

Adjustment by the clutch ring 20 being designed for the desired inclination of the articulated arms.

A further change of the force ratios can be attained by changing the distance I between the joints 9 on the dropout profile 11.

What is claimed is:

1. An articulated-arm awning comprising at least two articulated arms (1), each articulated arm (1) incorporating an inner and outer articulated arm section (2, 3) that are connected to one another by means of a joint (4) having a first swiveling axis; the outer articulated arm section (3) of each articulated arm (1) being connected in the region of its outer end to a dropout profile (11) by means of a joint (9) having a second swiveling axis (10); the inner end of each inner articulated arm section (2) being connected to a bearing on the building side by means of a joint (5) having a third swiveling axis (6); a tilting joint (7) that is rotatable around a horizontal swiveling axis being provided on each articulated arm (1); wherein the inner and outer articulated arm sections (2, 3) and joints (5, 9) are dimensioned and positioned such that when the dropout profile (11) is retracted, a lateral force parallel to the dropout profile (11) or building wall is exerted onto a tilting shaft (12) that has a horizontal longitudinal axis that extends along the horizontal swiveling axis and is mounted so that it can slide parallel to the horizontal longitudinal axis (15); wherein the tilting shaft (12) is mounted so that it can slide in the direction of the lateral force against the force of a spring (18); wherein a clutch (10) is provided that can be activated and deactivated in dependence upon this sliding movement of the tilting shaft (12) such that when the dropout profile (11) is retracted and the lateral force correspondingly exceeds that of the spring (18), the clutch (19) is disengaged and permits a swiveling of the tilting shaft (12) around the horizontal longitudinal axis (15), and that when the dropout profile (11) is extended, the clutch (19) is engaged and blocks the swiveling; and wherein the first, second and third swiveling axis are all perpendicular to the horizontal longitudinal axis.

2. An articulated-arm awning according to claim 1, wherein the inner articulated arm section (2) is longer than the outer articulated arm section (3).

3. An articulated-arm awning according to claim 1, wherein the tilting shaft (12) is supported in the region of a bracket (8) on two spaced-apart bearing rings (13, 14).

4. An articulated-arm awning according to claim 3, wherein the spring (18) is formed by a helical spring that is disposed between the bearing rings (13, 14) on the tilting shaft (12).

5. An articulated-arm awning according to claim 4, wherein two stop rings (16, 17), which permit a defined shifting in the axial direction of the tilting shaft (12) by an axial distance (S), are provided on both sides of one of the bearing rings (14).

6. An articulated-arm awning according to claim 1, wherein the clutch (19) is formed by a clutch ring (20) that is connected to the tilting shaft (12) integral in rotation therewith and has axially extending clutch projections (21), and by non-rotating clutch recesses (22).

7. An articulated-arm awning according to claim 6, wherein: the tilting shaft (12) is supported in the region of a bracket (8) on at least one bearing ring (13); and the clutch recesses (22) are formed on the outside of the at least one bearing ring (13).

* * * * *